US011299961B2

(12) United States Patent
Vick, Jr.

(10) Patent No.: US 11,299,961 B2
(45) Date of Patent: Apr. 12, 2022

(54) COMBINED CHEMICAL/BALANCE LINE

(71) Applicant: Halliburton Energy Services, Inc., Houston, TX (US)

(72) Inventor: James Dan Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/576,073

(22) Filed: Sep. 19, 2019

(65) Prior Publication Data

US 2020/0208497 A1 Jul. 2, 2020

(51) Int. Cl.

| | |
|---|---|
| ***E21B 34/10*** | (2006.01) |
| ***E21B 34/14*** | (2006.01) |
| ***E21B 43/25*** | (2006.01) |
| ***E21B 37/06*** | (2006.01) |
| ***E21B 34/16*** | (2006.01) |

(52) U.S. Cl.

CPC ..... *E21B 34/10* (2013.01); *E21B 34/14* (2013.01); *E21B 34/16* (2013.01); *E21B 37/06* (2013.01); *E21B 43/25* (2013.01); *E21B 2200/05* (2020.05)

(58) Field of Classification Search

CPC ..... E21B 34/14; E21B 2200/05; E21B 34/10; E21B 34/16; E21B 34/142; E21B 37/06; E21B 43/25; E21B 33/06

See application file for complete search history.

(56) References Cited

U.S. PATENT DOCUMENTS

| | | | | |
|---|---|---|---|---|
| 4,042,033 | A * | 8/1977 | Holland | E21B 34/105 166/310 |
| 4,421,174 | A | 12/1983 | McStravick et al. | |
| 5,179,973 | A * | 1/1993 | Dickson | E21B 29/08 137/433 |
| 6,148,920 | A * | 11/2000 | McCalvin | E21B 34/063 166/324 |
| 6,513,594 | B1 * | 2/2003 | McCalvin | E21B 34/10 166/320 |
| 7,234,524 | B2 | 6/2007 | Shaw et al. | |
| 7,314,091 | B2 * | 1/2008 | Wagner | E21B 34/102 166/386 |
| 8,893,799 | B2 * | 11/2014 | Garay | E21B 34/10 166/332.6 |
| 9,677,377 | B2 * | 6/2017 | Miller | E21B 34/101 |
| 9,725,994 | B2 * | 8/2017 | Frosell | E21B 37/06 |
| 2003/0168219 | A1 | 9/2003 | Sloan | |
| 2005/0098210 | A1 | 5/2005 | Strattan et al. | |

(Continued)

FOREIGN PATENT DOCUMENTS

WO 99/20869 A3 4/1999

*Primary Examiner* — Nicole Coy

(74) *Attorney, Agent, or Firm* — Scott Richardson; Parker Justiss, P.C.

(57) ABSTRACT

Provided is a safety valve. The safety valve, in one example, includes a piston located within a piston chamber, the piston separating the piston chamber into a first portion and a second portion and configured to slide to move a valve closure mechanism between a closed state and an open state. The safety valve, according to this example, includes a first control/balance line fluidically coupled to the first portion of the piston chamber, a second control/balance line fluidically coupled to the second portion of the piston chamber, and a chemical line fluidically coupled to the second control/balance line.

20 Claims, 6 Drawing Sheets

(56) References Cited

U.S. PATENT DOCUMENTS

| | | | | |
|---|---|---|---|---|
| 2010/0108320 | A1* | 5/2010 | Larnach | E21B 34/10 166/310 |
| 2011/0192480 | A1* | 8/2011 | Willauer | F16K 11/20 137/637 |
| 2012/0073829 | A1 | 3/2012 | Smith et al. | |
| 2015/0247384 | A1* | 9/2015 | Patel | E21B 43/16 166/222 |
| 2016/0053574 | A1 | 2/2016 | Miller et al. | |
| 2017/0268314 | A1 | 9/2017 | Jones et al. | |
| 2018/0202261 | A1 | 7/2018 | Scott et al. | |

* cited by examiner

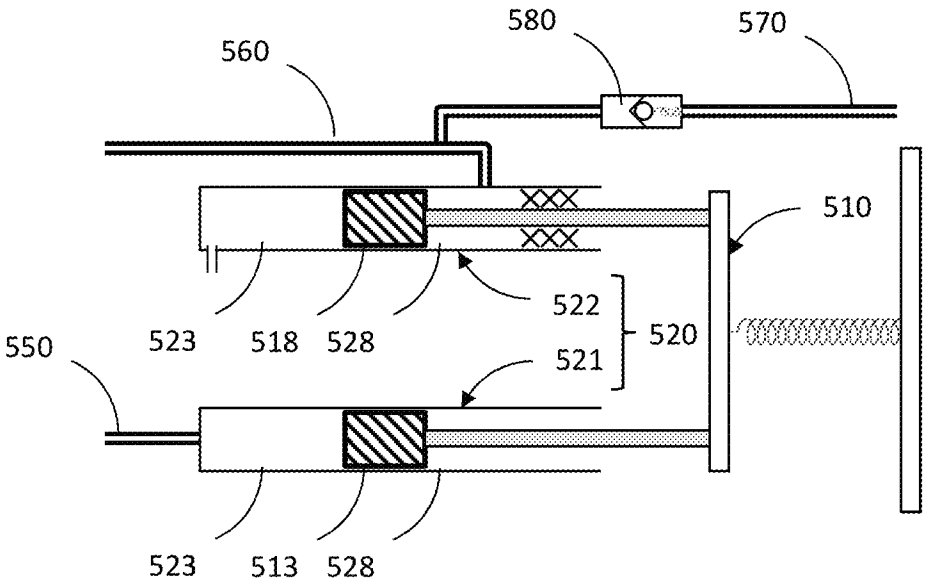
FIG. 5
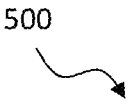

COMBINED CHEMICAL/BALANCE LINE

CROSS-REFERENCE TO RELATED APPLICATION

This application claims priority to International Application Number PCT/US2018/067857 filed on Dec. 28, 2018, entitled "COMBINED CHEMICAL/BALANCE LINE," which application is commonly assigned with this application and incorporated herein by reference in its entirety.

BACKGROUND

Surface-controlled subsurface safety valves (SCSSVs) are well known in the oil and gas industry and provide one of many failsafe mechanisms to prevent the uncontrolled release of wellbore fluids should a wellbore system experience a loss in containment. Typically, SCSSVs comprise a portion of a tubing string set in place during completion of a wellbore. Although a number of design variations are possible for subsurface safety valves, the vast majority are flapper-type valves that open and close in response to longitudinal movement of a flow tube. Since SCSSVs provide a failsafe mechanism, the default positioning of the flapper is usually closed in order to minimize the potential for inadvertent release of wellbore fluids. The flapper can be opened through various means of control from the earth's surface in order to provide a flow pathway for production to occur.

In many instances, the flow tube can be regulated from the earth's surface using a piston and rod assembly that may be hydraulically charged via a control line linked to a hydraulic manifold or control panel. The term "control line" will be used herein to refer to a hydraulic line configured to displace the flow tube of a subsurface safety valve downward upon pressurization, or otherwise to become further removed from the exit of a wellbore. When sufficient hydraulic pressure is conveyed to a SCSSV via the control line, the piston and rod assembly forces the flow tube downward, which causes the flapper to move into its open position upon overcoming forces that tend to keep the flapper closed (e.g., biasing springs, downhole pressure, and the like). When the hydraulic pressure is removed from the control line, the flapper can return to its default, closed position. A self-closing mechanism, such as a torsion spring, can also be present to promote closure of the flapper should a loss of hydraulic pressure occur.

Some SCSSVs also employ a second hydraulic line configured to counterbalance the effects of the control line and to provide an additional means of regulating the flow tube. The term "balance line" will be used herein to refer to a hydraulic line configured to displace the flow tube of a subsurface safety valve upward upon pressurization, or otherwise to become less removed from the exit of a wellbore. A balance line, when present, can operate in a similar manner to a control line and be controlled from the earth's surface.

In addition to the control line and balance line extending to the SCSSV, many configurations additionally employ a separate chemical line extending up to and/or past the SCSSV. The term "chemical line" will be used herein to refer to a hydraulic line configured to provide one or more different types of chemicals to a chemical injection system positioned within the wellbore.

Depending on operational considerations, an SCSSV may be placed hundreds to thousands of feet downhole. Accordingly, the control line and balance line, and when used the chemical line, must extend the hundreds of feet downhole to the SCSSV, and in the case of the chemical line, past the SCSSV. The cost of running multiple different lines to and/or past the SCSSV is significant. Accordingly, what is needed in the art is a SCSSV that does not experience the significant costs associated with existing SCSSVs.

BRIEF DESCRIPTION

Reference is now made to the following descriptions taken in conjunction with the accompanying drawings, in which:

FIG. 5 illustrates yet another alternative embodiment of a safety valve manufactured according to the disclosure.

DETAILED DESCRIPTION

Figure 1:
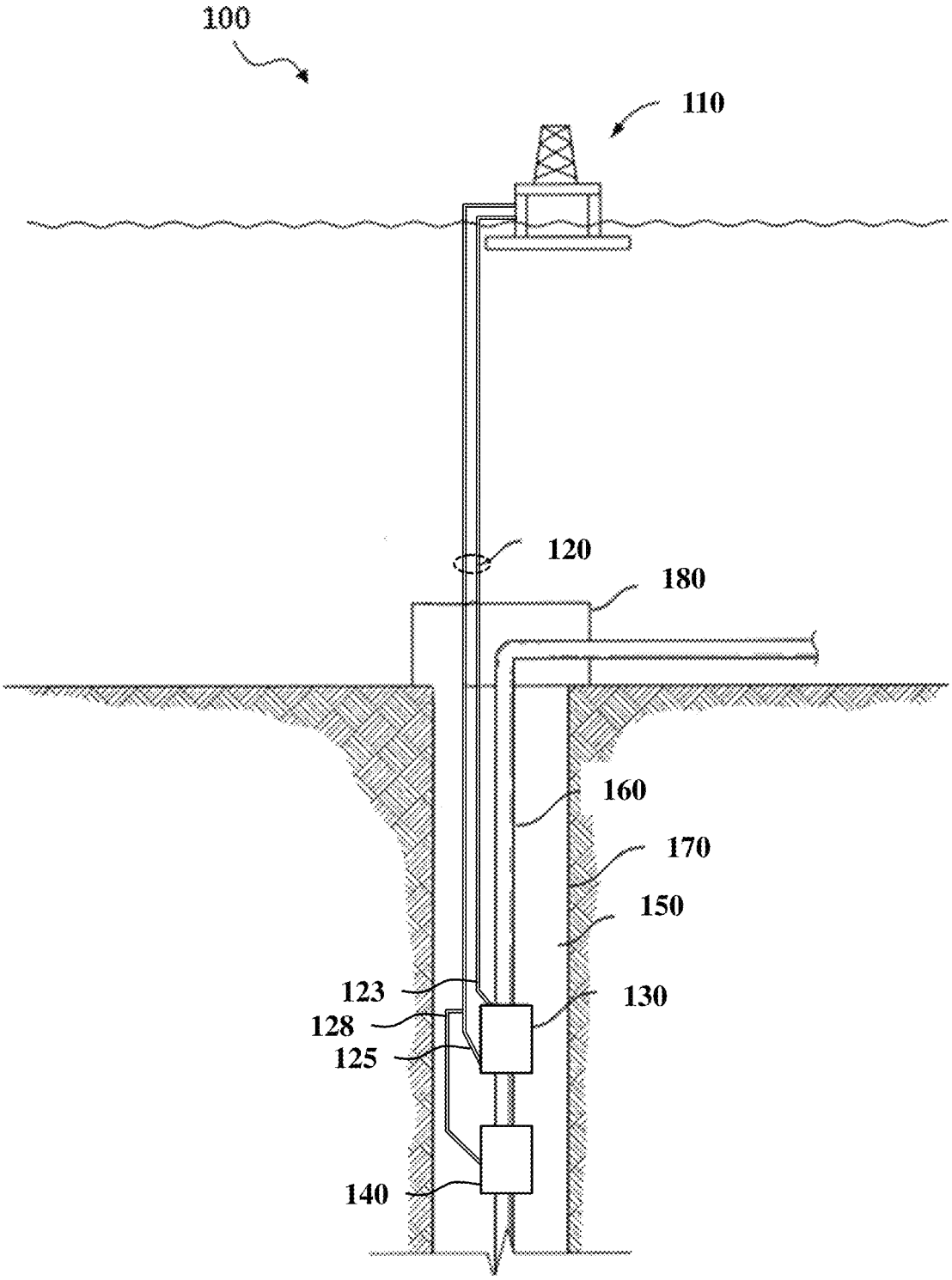
FIG. 1 illustrates a subterranean production well employing a safety valve constructed according to the principles of the present disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form, and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The description and drawings included herein merely illustrate the principles of the disclosure. It will thus be appreciated that those skilled in the art will be able to devise various arrangements that, although not explicitly described or shown herein, embody the principles of the disclosure and are included within its scope.

FIG. 1 illustrates a subterranean production well 100, including a surface installation 110 (e.g., an offshore platform in the embodiment shown) connected to a safety valve 130, such as an SCSSV, via hydraulic connection 120. In accordance with the disclosure, the hydraulic connection 120 includes a first control/balance line 123, a second control/balance line 125, and a chemical line 128 coupled to the second control/balance line 125. According to this embodiment, the first control/balance line 123 may be one of a control line or a balance line, and the second control/balance line 125 may be the other of the control line or the balance line. In the embodiment shown, the first control/balance line 123 is a control line, and the second control/balance line 125 is a balance line, and thus the chemical line 128 is coupled to the balance line. Nevertheless, the present disclosure should not be limited to just this embodiment, as the opposite is feasible in other configurations. Those skilled in the art understand the configuration and operation of the chemical injection system 140.

An annulus 150 may be defined between walls of wellbore 170 and a conduit 160. Wellhead 180 may provide a means to hand off and seal conduit 160 against wellbore 170 and provide a profile in which to latch a subsea blowout preventer. Conduit 160 may be coupled to wellhead 180. Conduit 160 may be any conduit such as a casing, liner, production tubing, or other tubulars disposed in a wellbore.

The safety valve 130 may be interconnected in conduit 160 and positioned in wellbore 170. Although the wellbore 170 is depicted in FIG. 1 as an offshore well, one of ordinary skill should be able to adopt the teachings herein to any type of well including onshore or offshore. The hydraulic connection 120 may extend into the well 170 and may be connected to the hydraulic line controlled device 130. The hydraulic connection 120 may provide control for the safety valve 130, including the actuation and/or de-actuation of the safety valve 130. In one embodiment, actuation may comprise opening the safety valve 130 to provide a flow path for wellbore fluids to enter conduit 160, and de-actuation may comprise closing the safety valve 130 to close a flow path for wellbore fluids to enter conduit 160.

Figure 2:
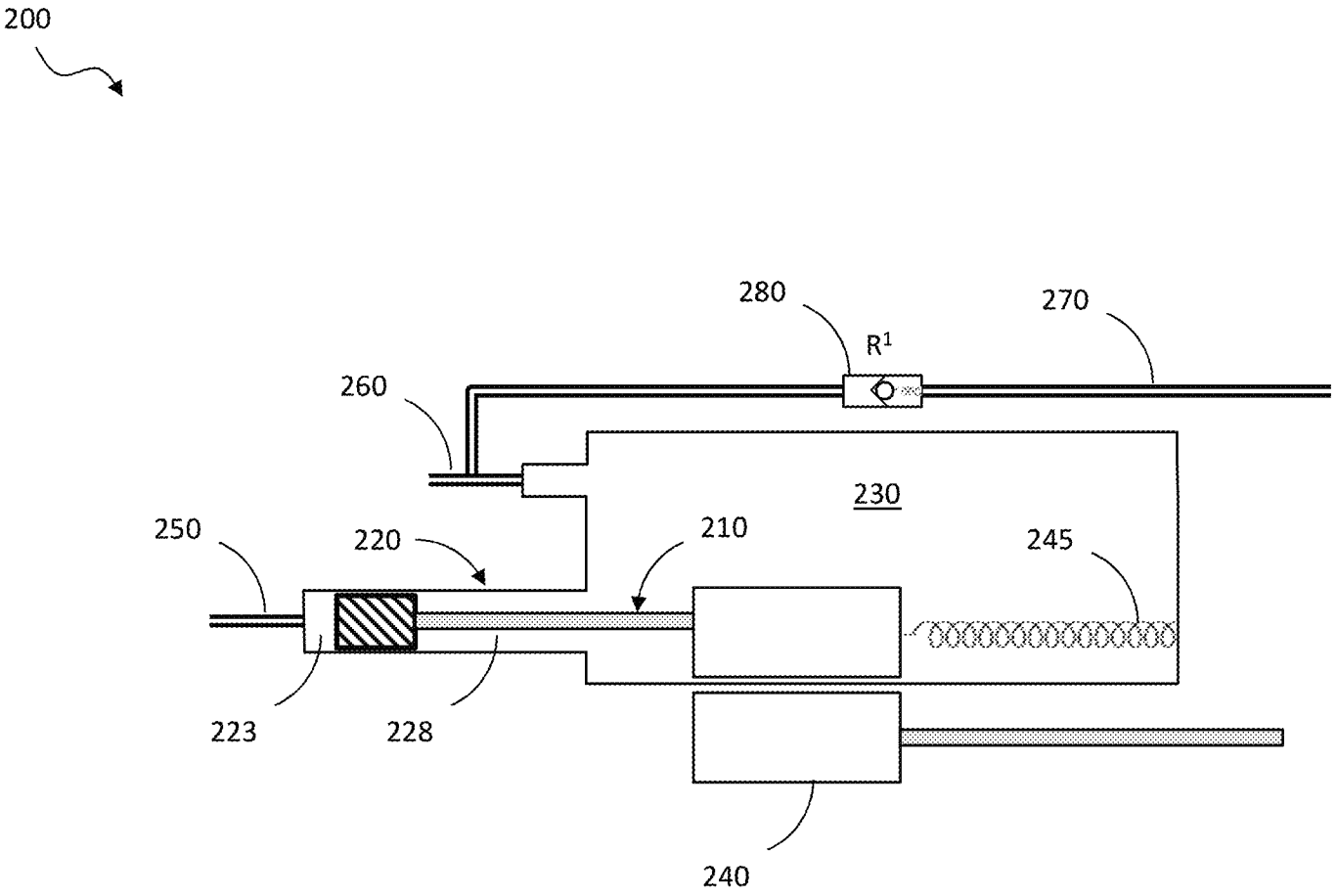
FIG. 2 illustrates a safety valve manufactured according to one embodiment of the disclosure.

Turning to FIG. 2 illustrated is a safety valve 200 manufactured according to one embodiment of the disclosure. The safety valve 200 of FIG. 2 includes a piston 210 located within a piston chamber 220. According to this embodiment, the piston 210 separates the piston chamber 220 into a first portion 223 and a second portion 228. As the piston 210 is configured to slide within the piston chamber 220, a fluid volume of the first and second portions 223, 228 may change.

In the embodiment of FIG. 2, a balance chamber 230 is fluidically coupled to the second portion 228 of the piston chamber 220. In accordance with this embodiment, among other configurations, the piston chamber 220 could form a single unit with the balance chamber 230, the piston 210 extending into the piston chamber 220 and thus separating the piston chamber 220 into the first and second portions 223, 228. As will be discussed below, other embodiments exist wherein a safety valve according to the present disclosure does not employ a balance chamber 230.

Coupled to the piston 210 in the embodiment of FIG. 2 is a valve closure mechanism 240. The valve closure mechanism 240, in this embodiment, is that portion of the safety valve 200 that might open and/or close the flow path for wellbore fluids to enter a hydrocarbon conduit, such as the conduit 160 of FIG. 1. For example, if the safety valve 200 were a linear safety valve, the valve closure mechanism 240 might be a flow tube that is configured to open and/or close a flapper valve, among other linear safety valve configurations. In turn, if the safety valve 200 were a ball valve, the valve closure mechanism 240 might be a control arm configured to rotate a ball mechanism within the ball valve, among other ball valve configurations.

In the embodiment of FIG. 2, the piston 210 is magnetically coupled to the valve closure mechanism 240 through a wall of the balance chamber 230. Accordingly, as the piston 210 slides within the piston chamber 220, the valve closure mechanism correspondingly slides to move between the aforementioned closed and open states. The present disclosure should not be limited to any specific type of coupling between the piston 210 and the valve closure mechanism 240, or any specific type of valve closure mechanism 240. In the illustrated embodiment, a return spring 245 is coupled to the piston 210. A self-closing mechanism 245, such as a torsion spring among others, can also be present to return the piston 210 to its unactuated state should a loss of hydraulic pressure occur (e.g., whether turned off or cut to the safety valve).

In the illustrated embodiment, a first control/balance line 250 is fluidically coupled to the first portion 223 of the piston chamber 220. As further illustrated in the embodiment of FIG. 2, a second control/balance line 260 is fluidically coupled to the second portion 228 of the piston chamber 220. The second control/balanced line 260 may be directly coupled to the second portion 228, or alternatively (e.g., as shown in FIG. 2), the second control/balance line 260 may be fluidically coupled to the second portion 228 through an intermediary conduit. For example, as illustrated in FIG. 2, the second control/balance line 260 is coupled to the second portion 228 through the balance chamber 230. Other configurations, beyond these two discussed, are within the scope of the disclosure.

In accordance with the disclosure, a chemical line 270 is fluidically coupled to the second control/balance line 260. For example, in the embodiment shown, the chemical line 270 is physically coupled directly to the second control/balance line 260. Other embodiments may exist, however, wherein the chemical line 270 is fluidically coupled to the second control/balance line 260 via an intermediary conduit. One such example is illustrated below with regard to FIG. 4. Accordingly, the present disclosure should not be limited (e.g., unless otherwise denoted) to any specific coupling between the chemical line 270 and the second control/balance line 260.

As is illustrated above with regard to FIG. 1, the first and second control/balance lines 250, 260 may extend from a surface installation to the safety valve 200. In the illustrated embodiment of FIG. 2, the first control/balance line 250 operates as the control line, and the second control/balance line 260 operates as the balance line. Notwithstanding, other embodiments exist wherein the first control/balance line 250 operates as the balance line, and the second control/balance line 260 operates as the control line. In the embodiment wherein the second control/balance line 260 is the balance line, the chemical line 270 is fluidically coupled to the balance line. In accordance with this example, the second control/balance line 260 functions as a shared control/balance/chemical line.

In the illustrated embodiment of FIG. 2, a one way pressure relief valve 280 is associated with the chemical line. The one way pressure relief valve 280, in this embodiment, is configured to bleed fluid from the second control/balance line 260 to the chemical line 270. While the one way pressure relief valve 280 is illustrated as an in-line valve in FIG. 2, other embodiments may exist wherein the one way pressure relief valve 280 is not in-line. In accordance with the disclosure, the one way pressure relief valve 280 includes a relief pressure ($R^1$) necessary to allow fluid to pass thereby. For example, the one way pressure relief valve 280 may only open once the relief pressure ($R^1$) is achieved and/or exceeded. In those instances where the relief pressure ($R^1$) is not met, the one way pressure relief valve 280 remains closed. In contrast, in those instances where the relief pressure ($R^1$) is met or exceeded, the one way pressure relief valve 280 will open.

Other embodiments may exist wherein the one way pressure relief valve 280 is exchanged for a flow restrictor (not shown). The flow restrictor, in used, would constantly bleed fluid from the second control/balance line 260 to the chemical line 270, and thus to the chemical injection tool. The size of the flow restrictor would be appropriately manufactured to provide the requisite amount of back pressure on the second control/balance line 260, while allowing fluid to bleed to the chemical line 270. Those skilled in the art, when presented with the novel aspects of the present disclosure, would be able to manufacture and employ a flow restrictor as detailed herein.

Figure 3A:
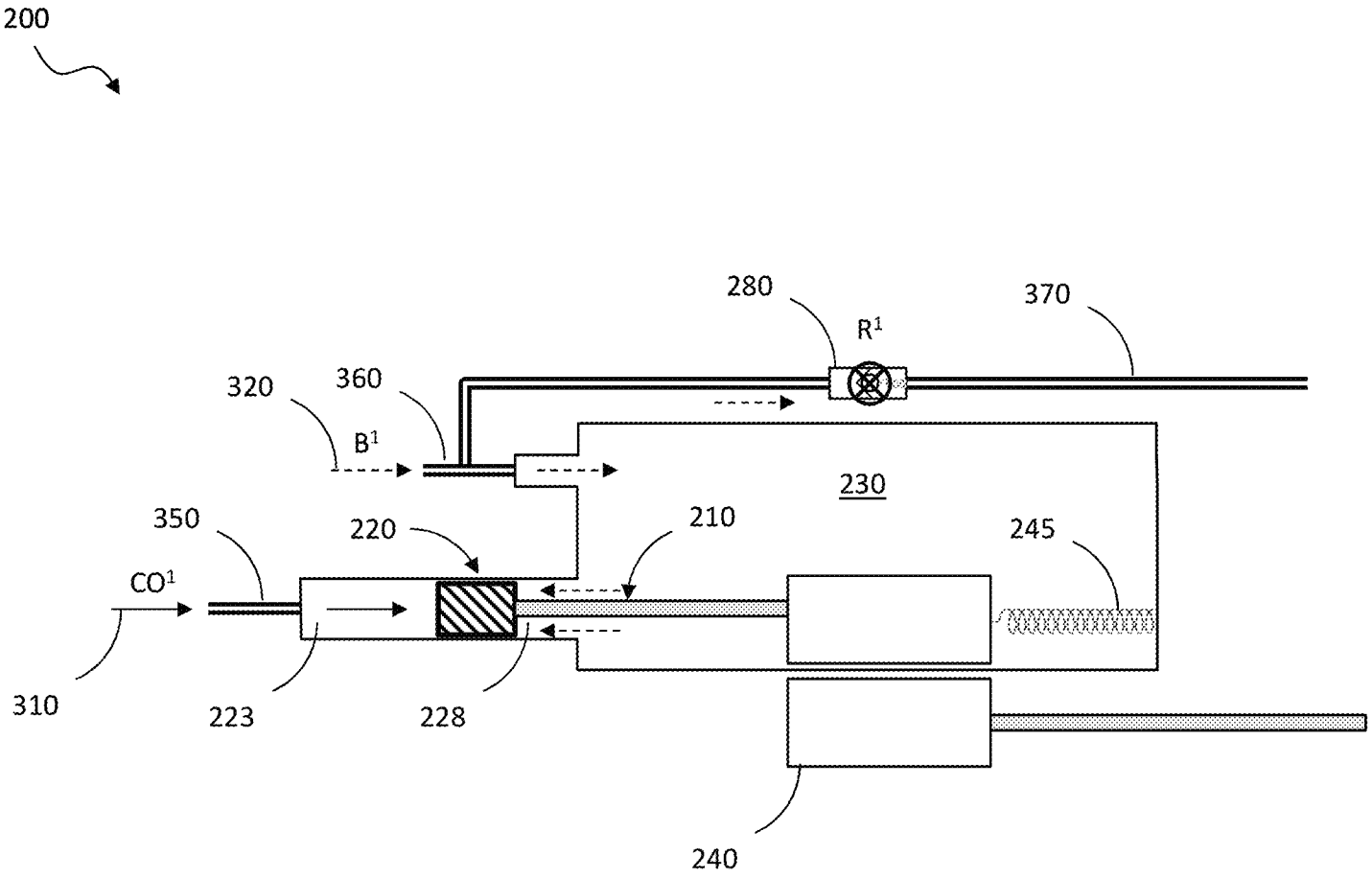
FIGS. 3A and 3B illustrate the safety valve of FIG. 2 at various different operational states.
Figure 3B:
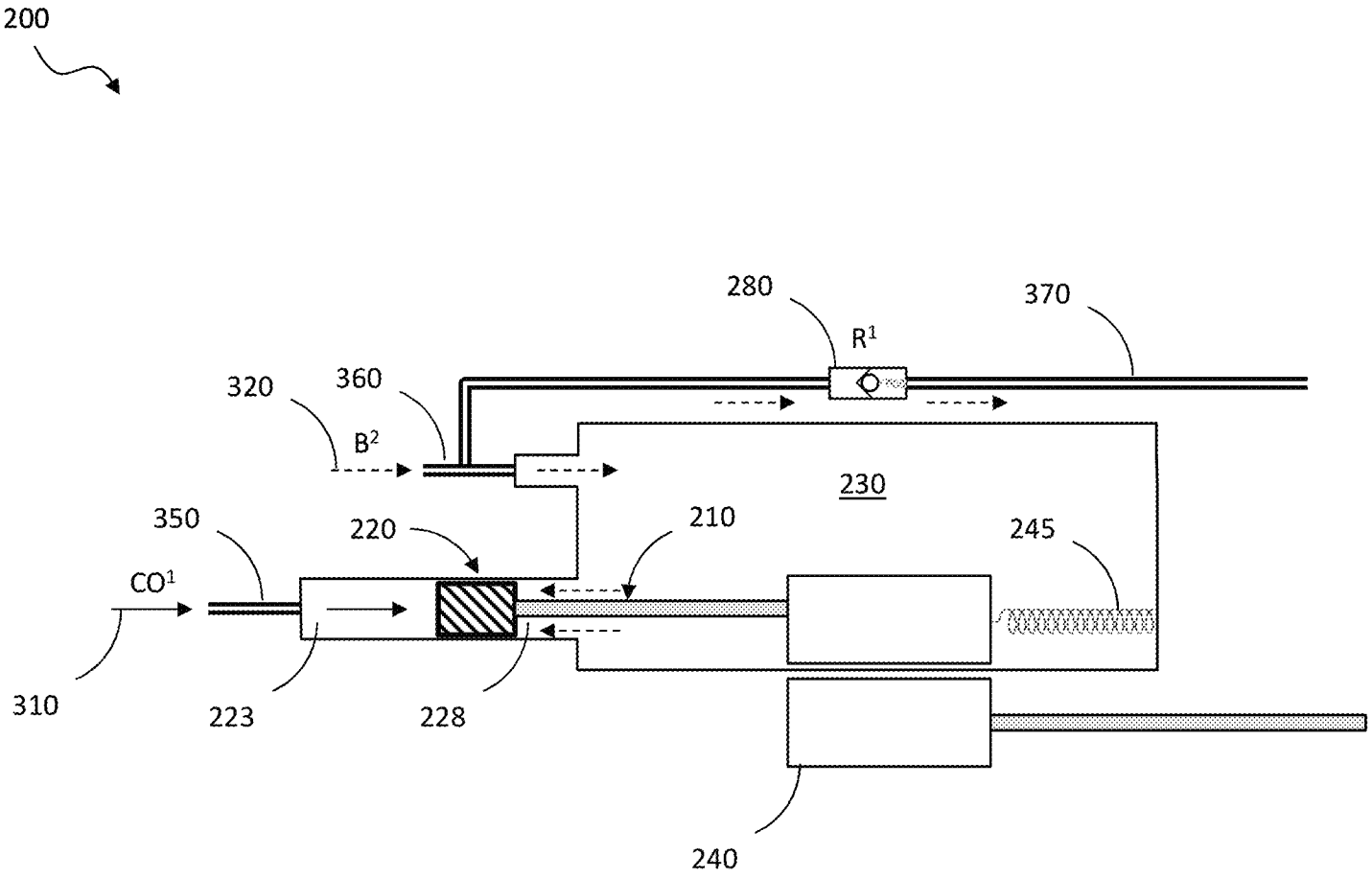

Turning now to FIGS. 3A and 3B, illustrated is the safety valve 200 of FIG. 2 at various different operational states. The embodiment of FIGS. 3A and 3B will be discussed and illustrated with the understanding that the first control/balance line 250 is a control line 350, and that the second control/balance line 260 is a balance line 560. However, as discussed above, the opposite could hold true and remain within the purview of the disclosure. FIG. 3A illustrates the safety valve 200 in a first operational state, for example, wherein the safety valve 200 is in an open and balanced state. As illustrated in FIG. 3A, such a balanced state may be achieved by pumping control fluid 310 down the control line 350 until a first control pressure ($CO^1$) is attained, and pumping balance fluid 320 down the balance line 360 until a first balance pressure ($B^1$) is attained.

The balance fluid 320, in accordance with the disclosure, may be a chemical injection fluid. The term chemical injection fluid, as that term is used herein, means a fluid that has other downhole uses than just as a hydraulic actuation fluid. In one example embodiment, the chemical injection fluid has greater weight than the control line fluid, and thus provides a greater hydrostatic head, which is beneficial in assisting the safety valve to close. In accordance with the embodiment of FIGS. 3A and 3B, the first control pressure ($CO^1$) is greater than the first balance pressure ($B^1$), and furthermore, the first balance pressure ($B^1$) is less than the relief pressure ($R^1$). As an example, the first control pressure ($CO^1$) might be about 10,000 psi, the first balance pressure ($B^1$) might be about 5,000 psi, and the relief pressure ($R^1$) might be about 6,000 psi.

In the balanced state, the piston 210 moves within the piston chamber 220, as may be observed when comparing the safety valve 200 of FIG. 2 and that of FIG. 3A. As the valve closure mechanism 240 is connected (e.g., magnetically, mechanically or otherwise) to the piston 210, any movement in the piston 210 translated to movement in the valve closure mechanism 240. Thus, the valve closure mechanism 240 slides to open the safety valve 200.

Turning to FIG. 3B, illustrated is the safety valve 200 in second operational state, as may be the case when fluid from the safety valve 200 is being used to operate a chemical injection system (e.g., such as the chemical injection system 140 of FIG. 1). In the illustrated embodiment of FIG. 3B, the first balance pressure ($B^1$) has been increased to a second balance pressure ($B^2$). The second balance pressure ($B^2$), in this example, is greater than the relief pressure ($R^1$), but still less than the first control pressure ($CO^1$). As the second balance pressure ($B^2$) is greater than the relief pressure ($R^1$), the one way pressure relief valve 280 opens, and thus allows the balance fluid 320 to bleed from the balance line 360 entirely through the chemical line 370. In this embodiment, the one way pressure relief valve 280 will remain open so long as the second balance pressure ($B^2$) is greater than the relief pressure ($R^1$). Accordingly, an operator of the safety valve 200 could maintain the second balance pressure ($B^2$) at a pressure greater than the relief pressure ($R^1$) so long as it is desired to provide the balance fluid (e.g., chemical injection fluid) to the chemical injection system. Using the pressures discussed above, the first balance pressure ($B^1$) could be increased from the about 5,000 psi to a second balance pressure ($B^2$) of about 7,000 psi. Again, as the second balance pressure ($B^2$) is greater than the relief pressure ($R^1$), the balance fluid bleeds from the second control/balance line 360 to the chemical injection system.

The above example is based upon the premise that the first control pressure ($CO^1$) is operationally greater than the relief pressure ($R^1$). Another embodiment could exist wherein the first control pressure ($CO^1$) is operationally below the relief pressure ($R^1$). In such an embodiment, the first control pressure ($CO^1$) could be temporarily increased to a second control pressure ($CO^2$) that is greater than the relief pressure ($R^1$), and then the first balance pressure ($B^1$) could be increased to second balance pressure ($B^2$) greater than the relief pressure ($R^1$). In such an example, the first control pressure ($CO^1$) might be about 4,000 psi, the second control pressure ($CO^2$) might be about 10,000 psi, the first balance pressure ($B^1$) might be about 3,000 psi, the second balance pressure ($B^2$) might be about 7,000 psi, and the relief pressure ($R^1$) might be about 6,000 psi. While specific pressure values have been given, those skilled in the art understand that the present disclosure is not limited to any specific pressure values.

Those skilled in the art understand that the increase in pressure from the first balance pressure ($B^1$) to the second balance pressure ($B^2$) may be achieved in a number of different ways. First, the increase may be natural. For instance, an increase in temperature downhole may naturally cause the pressure to increase, and if the increase in temperature is enough, may cause the pressure to increase to the second balance pressure ($B^2$). Accordingly, even if there were no need to send the balance fluid 320 to the chemical injection system, the one way pressure relief valve 280 may be used to keep the pressure on the backside of the piston 210 below a threshold valve. Second, the increase may be intentional, for example wherein additional balance fluid 320 is pumped downhole through the balance line 360. This second intentional pumping of balance fluid 330 may be used to intentionally bleed balance fluid 320 through the one way relief valve 280 for use in the chemical injection system.

In the illustrated embodiment of FIGS. 3A and 3B, the balance line 340 extending from uphole functions as a combined balance/chemical line. Accordingly, it is not necessary to run three separate lines downhole from the surface installation, as two will suffice.

Figure 4:
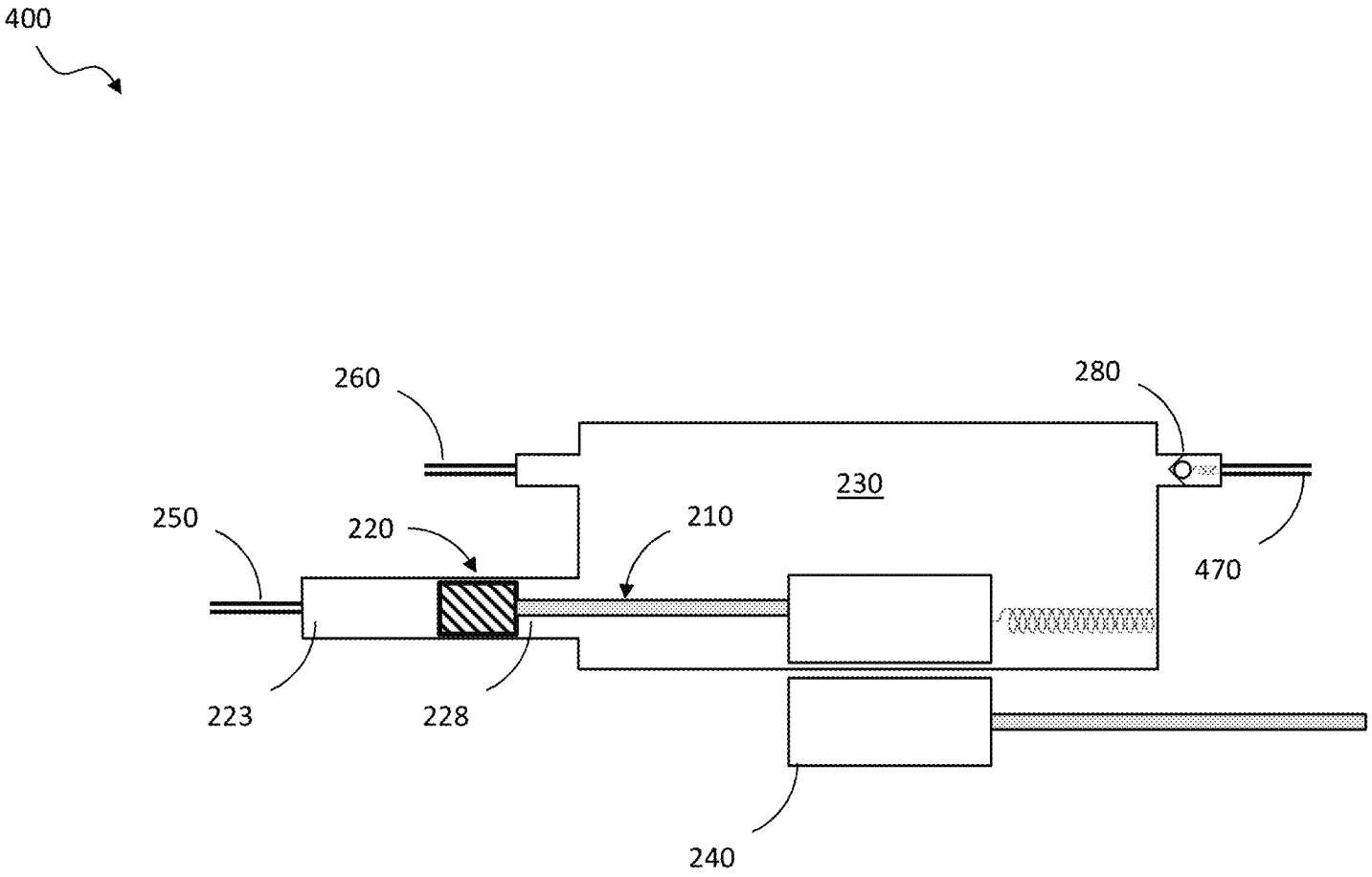
FIG. 4 illustrates an alternative embodiment of a safety valve manufactured according to the disclosure.

Turning now to FIG. 4, illustrated is an alternative embodiment of a safety valve 400 manufactured according to the disclosure. The safety valve 400 is similar in many respects to the safety valve 200 discussed above with respect to FIG. 2. Accordingly, similar reference numbers have been used to indicate similar (e.g., somewhat similar, very similar, or identical) features. The safety valve 400 illustrated in FIG. 4 differs from the safety valve 200, for the most part, in that the chemical line 470 is in fluid communication with the second control/balance line 260, but in this case through the balance chamber 230. For example, in the embodiment of FIG. 4, the chemical line 470 is directly coupled to the balance chamber 230. Further to this embodiment, the one way pressure relieve valve 280 is coupled in-line between the balance chamber 230 and the chemical line 470.

Turning to FIG. 5, illustrated is yet another embodiment of a safety valve 500 manufactured according to the disclosure. The safety valve 500 differs from the safety valves 200 and 400 of FIGS. 2 and 4, in many respects, one of which is that it does not employ the balance chamber. The safety valve 500, in the illustrated embodiment, includes a piston 510 positioned within a piston chamber 520. For example, the piston 510 includes a first piston portion 513 and a second piston portion 518. Similarly, the piston chamber 520 collectively includes a first piston chamber 521 and a second piston chamber 522. In the illustrated embodiment, the first and second piston chambers 521, 522 are separated by the first and second piston portions 513, 518, into first portions 523 and second portions 528.

In accordance with the embodiment of FIG. 5, a first control/balance line 550 is coupled to the first portion 523 of the first or second piston chambers 521, 522, and a second control/balance line 560 is coupled to the second portion 528 of the first or second piston chambers 521, 522. In accordance with this embodiment, a chemical line 570 is fluidically coupled to the second control/balance line 560. Furthermore, the second portion 528 of the first piston chamber 521 and the first portion 523 of the second piston chamber 522 may be open to the section pressure within the wellbore. The safety valve 500 of FIG. 5 additionally includes a one way pressure relief valve 580, and thus can operate in a manner similar to the safety valves 200, 400 illustrated in FIGS. 2 and 4.

Aspects disclosed herein include:

A. A safety valve comprising: a piston located within a piston chamber, the piston separating the piston chamber into a first portion and a second portion and configured to slide to move a valve closure mechanism between a closed state and an open state; a first control/balance line fluidically coupled to the first portion of the piston chamber; a second control/balance line fluidically coupled to the second portion of the piston chamber; and a chemical line fluidically coupled to the second control/balance line.

B. A subterranean production well comprising: a surface installation positioned over a wellbore; a conduit positioned within the wellbore; a safety valve positioned within the conduit, the safety valve including 1) a valve closure mechanism; and 2) a piston located within a piston chamber and coupled to the valve closure mechanism, the piston separating the piston chamber into a first portion and a second portion and configured to slide to move the valve closure mechanism between a closed state and an open state; a chemical injection system positioned within the wellbore; a first control/balance line extending from the surface installation and fluidically coupled to the first portion of the piston chamber; a second control/balance line extending from the surface installation and fluidically coupled to the second portion of the piston chamber; and a chemical line fluidically coupling the chemical injection system and the second control/balance line.

C. A method for operating a subterranean production well comprising: placing a conduit within a wellbore located below a surface installation; positioning a safety valve within the conduit, the safety valve including 1) a valve closure mechanism; and 2) a piston located within a piston chamber and coupled to the valve closure mechanism, the piston separating the piston chamber into a first portion and a second portion and configured to slide to move the valve closure mechanism between a closed state and an open state; positioning a chemical injection system within the wellbore; fluidically coupling a first control/balance line from the surface installation to the first portion of the piston chamber; fluidically coupling a second control/balance line from the surface installation to the second portion of the piston chamber; and fluidically coupling a chemical line between the chemical injection system and the second control/balance line, the chemical line having a one way pressure relief valve associated therewith, the one way pressure relief valve configured to bleed fluid from the second control/balance line to the chemical injection system.

Aspects A, B, and C may have one or more of the following additional elements in combination: Element 1: wherein the first control/balance line is a control line and the second control/balance line is a balance line, and further wherein the chemical line is fluidically coupled to the balance line. Element 2: wherein the chemical line is physically coupled directly to the second control/balance line. Element 3: wherein a balance chamber is fluidically coupled to the second portion of the piston chamber, and further wherein the second control/balance line is physically coupled to the balance chamber. Element 4: wherein the chemical line is directly coupled to the balance chamber. Element 5: further including a one way pressure relief valve associated with the chemical line, the one way pressure relief valve configured to bleed fluid from the second control/balance line to the chemical line. Element 6: further including a self-closing mechanism coupled to the piston, and further wherein a relief pressure ($R^1$) required to open the one way pressure relief valve is greater than a second control/balance line pressure ($B^2$) necessary to help counterbalance the piston. Element 7: further including a flow restrictor associated with the chemical line, the flow restrictor configured to bleed fluid from the second control/balance line to the chemical line. Element 8: wherein the piston is magnetically coupled to the valve closure mechanism, and further wherein moving the piston slides the valve closure mechanism between a closed state and an open state. Element 9: further including pumping control fluid having a first control pressure ($CO^1$) through the control line to the first portion, and pumping chemical injection fluid having a first balance pressure ($B^1$) through the balance line to the second portion to counterbalance the piston, the first control pressure ($CO^1$) being greater than the first balance pressure ($B^1$). Element 10: wherein a relief pressure ($R^1$) required to open the one way pressure relief valve is greater than the first balance pressure ($B^1$), and further including increasing the first balance pressure ($B^1$) to a second balance pressure ($B^2$) greater than or equal to the relief pressure ($R^1$) but less than or equal to the first control pressure ($CO^1$), the increasing causing chemical injection fluid from the balance line to bleed to the chemical injection system.

Those skilled in the art to which this application relates will appreciate that other and further additions, deletions, substitutions and modifications may be made to the described embodiments.

What is claimed is:

1. A safety valve, comprising:

a piston located within a piston chamber, the piston separating the piston chamber into a first portion and a second portion and configured to slide to move a valve closure mechanism between a closed state and an open state, wherein the first portion of the piston chamber is positioned uphole of the piston and the second portion of the piston chamber is positioned downhole of the piston, and wherein the valve closure mechanism is positioned downhole of the piston;

a first control/balance line fluidically coupled to the first portion of the piston chamber and extends from the safety valve to a surface installation;

a second control/balance line fluidically coupled to the second portion of the piston chamber and extends from the safety valve to the surface installation;

a chemical line fluidically coupled to the second control/balance line; and a one way valve associated with the chemical line, the one way valve configured to bleed/control fluid from the second control/balance line to the chemical line, wherein the valve closure mechanism can move from a closed state to an open state once fluid from the second control/balance line flows to the chemical line through the one way valve.

2. The safety valve as recited in claim 1, wherein the first control/balance line is a control line and the second control/balance line is a balance line, and further wherein the chemical line is fluidically coupled to the balance line.

3. The safety valve as recited in claim 1, wherein the chemical line is physically coupled directly to the second control/balance line.

4. The safety valve as recited in claim 1, wherein a balance chamber is fluidically coupled to the second portion of the piston chamber, and further wherein the second control/balance line is physically coupled to the balance chamber.

5. The safety valve as recited in claim 4, wherein the chemical line is directly coupled to the balance chamber.

6. The safety valve as recited in claim 1, wherein the one way valve associated with the chemical line is a one way pressure relief valve, the one way pressure relief valve configured to bleed fluid from the second control/balance line to the chemical line.

7. The safety valve as recited in claim 6, further including a self-closing mechanism coupled to the piston, and further wherein a relief pressure ($R^1$) required to open the one way pressure relief valve is greater than a second control/balance line pressure ($B^2$) necessary to help counterbalance the piston.

8. The safety valve as recited in claim 1, wherein the piston is magnetically coupled to the valve closure mechanism, and further wherein moving the piston slides the valve closure mechanism between a closed state and an open state.

9. A subterranean production well, comprising:

a surface installation positioned over a wellbore;

a conduit positioned within the wellbore;

a safety valve positioned within the conduit, the safety valve including;

a valve closure mechanism; and a piston located within a piston chamber and coupled to the valve closure mechanism, the piston separating the piston chamber into a first portion and a second portion and configured to slide to move the valve closure mechanism between a closed state and an open state, wherein the first portion of the piston chamber is positioned uphole of the piston and the second portion of the piston chamber is positioned downhole of the piston;

a chemical injection system positioned within the wellbore;

a first control/balance line extending from the surface installation and fluidically coupled to the first portion of the piston chamber;

a second control/balance line extending from the surface installation and fluidically coupled to the second portion of the piston chamber;

a chemical line fluidically coupling the chemical injection system and the second control/balance line; and a one way valve associated with the chemical line, the one way valve configured to bleed/control fluid from the second control/balance line to the chemical line, wherein the valve closure mechanism can move from a closed state to an open state once fluid from the second control/balance line flows to the chemical line through the one way valve.

10. The subterranean production well as recited in claim 9, wherein the first control/balance line is a control line and the second control/balance line is a balance line, and further wherein the chemical line is fluidically coupled to the balance line.

11. The subterranean production well as recited in claim 9, wherein the chemical line is physically coupled directly to the second control/balance line.

12. The subterranean production well as recited in claim 9, wherein a balance chamber is fluidically coupled to the second portion of the piston chamber, and further wherein the second control/balance line is physically coupled to the balance chamber.

13. The subterranean production well as recited in claim 12, wherein the chemical line is directly coupled to the balance chamber.

14. The subterranean production well as recited in claim 9, wherein the one way valve associated with the chemical line is a one way pressure relief valve, the one way pressure relief valve configured to bleed fluid from the second control/balance line to the chemical injection system.

15. The subterranean production well as recited in claim 14, further including a self-closing mechanism coupled to the piston, and further wherein a relief pressure ($R^1$) required to open the one way pressure relief valve is greater than a second control/balance line pressure ($B^2$) necessary to counterbalance the piston.

16. The subterranean production well as recited in claim 9, wherein the piston is magnetically coupled to the valve closure mechanism, and further wherein moving the piston slides the valve closure mechanism between a closed state and an open state.

17. A method for operating a subterranean production well, comprising:

placing a conduit within a wellbore located below a surface installation;

positioning a safety valve within the conduit, the safety valve including;

a valve closure mechanism; and a piston located within a piston chamber and coupled to the valve closure mechanism, the piston separating the piston chamber into a first portion and a second portion and configured to slide to move the valve closure mechanism between a closed state and an open state, wherein the first portion of the piston chamber is positioned uphole of the piston and the second portion of the piston chamber is positioned downhole of the piston;

positioning a chemical injection system within the wellbore;

fluidically coupling a first control/balance line from the surface installation to the first portion of the piston chamber;

fluidically coupling a second control/balance line from the surface installation to the second portion of the piston chamber; and fluidically coupling a chemical line between the chemical injection system and the second control/balance line, the chemical line having a one way pressure relief valve associated therewith, the one way pressure relief valve configured to bleed fluid from the second control/balance line to the chemical injection system, wherein the valve closure mechanism can move from a closed state to an open state once fluid from the second control/balance line flows to the chemical line through the one way valve.

18. The method as recited in claim 17, wherein the first control/balance line is a control line and the second control/balance line is a balance line, and further wherein the chemical line is fluidically coupled to the balance line.

19. The method as recited in claim 18, further including pumping control fluid having a first control pressure ($CO^1$) through the control line to the first portion, and pumping chemical injection fluid having a first balance pressure ($B^1$) through the balance line to the second portion to counterbalance the piston, the first control pressure ($CO^1$) being greater than the first balance pressure ($B^1$).

20. The method as recited in claim 19, wherein a relief pressure ($R^1$) required to open the one way pressure relief valve is greater than the first balance pressure ($B^1$), and further including increasing the first balance pressure ($B^1$) to a second balance pressure ($B^2$) greater than or equal to the relief pressure ($R^1$) but less than or equal to the first control pressure ($CO^1$), the increasing causing chemical injection fluid from the balance line to bleed to the chemical injection system.

* * * * *